United States Patent [19]

Charkovsky et al.

[11] Patent Number: 4,805,424

[45] Date of Patent: Feb. 21, 1989

[54] SINGLE WARP-KNITTED PILE FABRIC

[75] Inventors: Alexandr V. Charkovsky, Vitebsk; Natalya B. Dobrova, Moscow; Vladimir N. Filatov, Moscow; Naum A. Iofis, Moscow; Alexandr S. Bukatov, Moscow; Zinaida P. Danilova, Moscow; Alexandr V. Kovarsky, Moscow; Jury G. Egorov, Moscow, all of U.S.S.R.

[73] Assignee: Vitebsky Tekhnologichesky Institut Legkoi Promyshlennosti, Vitebsk, U.S.S.R.

[21] Appl. No.: 150,396

[22] Filed: Jan. 29, 1988

[30] Foreign Application Priority Data

Jan. 23, 1987 [SU] U.S.S.R. ..... 4177270

[51] Int. Cl.[4] ..... D04B 7/12

[52] U.S. Cl. ..... 66/194

[58] Field of Search ..... 66/194, 195

[56] References Cited

U.S. PATENT DOCUMENTS 3,845,641 11/1974 Waller ..... 66/192

4,567,075 1/1986 Krawczyk ..... 66/194

*Primary Examiner*—Ronald Feldbaum

*Attorney, Agent, or Firm*—Burgess, Ryan & Wayne

[57] ABSTRACT

A single warp-knitted pile fabric comprising loop courses of ground and pile threads, wherein the loops of the pile threads are run jointly with the ground loops and interconnected by the floats of these loops. Transfers are run on from the pile threads in the same courses as the loops of these pile threads. The floats of the transfers are laid in some courses to overlie the floats of the ground loops, whereas in other courses the floats of the transfers are laid to underlie the floats of the ground loops.

5 Claims, 3 Drawing Sheets

SINGLE WARP-KNITTED PILE FABRIC

FIELD OF THE INVENTION

The present invention relates to the production of knitted fabrics, and more particularly it relates to single warp-knitted pile fabrics that can be used in various industries, such as in medical, chemical, furniture-making and others, as well as in production of clothing.

SUMMARY OF THE PRIOR ART

There is known a single warp-knitted pile fabric comprising loop courses of ground or leading threads and of pile threads, wherein the loops of the pile threads are run jointly with the ground threads and interconnected by floating lengths of the threads or floats. In this known fabric the loops of each pile thread are formed in different courses and in different columns of the loops. Consequently, one of the necks or floats of such a pile loop passes over the floats of the ground loops towards a pile loop situated in the lower loop course, whereas the other neck or float of the pile loop passes likewise over the floats of the ground loops towards a pile loop situated in the upper loop course, the pile floats forming the pile of the fabric (A. S. Dalidovich "Osnovy teorii vyazaniya", Moscow, 1970, p. 264, FIG. 129).

However, this arrangement of the pile threads would not provide for sufficient surface-filling of the knitted fabric. In the process of manufacture of articles from such knitted fabric, there is a tendency of formation of pulled-in or tight threads, whereas a cut edge of such fabric displays a tendency to running, which hinders its use, particularly when it is used for making various medical articles.

OBJECTS AND SUMMARY OF THE INVENTION

It is an object of the present invention to provide a single warp-knitted pile fabric with an enhanced degree of surface-filling.

It is another object of the present invention to fight the tendency of the fabric to form pulled-in threads.

It is yet another object of the present invention to minimize the running of cut edges of the fabric.

These and other objects are attained in a single warp-knitted fabric comprising loop courses of ground threads and pile threads, wherein the loops of the pile threads are run jointly with the loops of the ground threads and are interconnected by floats, in which fabric, in accordance with the invention, transfers are run on from the pile threads in the same loop courses as the loops of these pile threads, the floats of the transfers in some courses being laid to overlie the floats of the ground loops, wherein in other courses the floats of the transfers are laid to underlie the floats of the ground loops.

It is expedient that the loop courses where the floats of the transfers overlie the floats of the ground loops should alternate in the fabric with the loop courses where the floats of the transfers underlie the floats of the ground loops.

The transfers of the pile threads can be arranged in the loop courses either to one and the same side of the loops of these pile threads, or to the opposite sides of the loops of these pile threads in adjacent loop courses.

It can be expedient to have one of the floats of each transfer of the pile threads in a loop course where it underlies the floats of the ground loops led to the side opposite to the location of the transfer, to interlock the float of a ground loop situated in the same loop course to the other side of the loop of the pile thread.

Thus, in the disclosed pile fabric the transfers of the pile threads are inlaid in the same loop courses as the loops of these pile threads, with the floats of the transfers in some courses overlying the floats of the ground threads, and in other courses underlying the floats of the ground threads. This arrangement of the pile threads provides for fine overlapping of the through openings in the loops and of the clearances between the loops, thus enhancing the surface-filling degree of the knitted fabrice. The reduced tendency to form pulled-in threads has been attained owing to the floats of the transfers overlying the floats of the ground loops alternating with the floats of the transfers underlying the floats of the ground loops, to opposite sides of the loops of the pile threads.

This arrangement of the pile threads steps up the number of the points of engagement of the pile threads with the ground threads, increasing the friction therebetween and thus fighting the tendency to formation of pulled-in threads. This stepped up number of the points of engagement of the pile threads with the ground loops also mimizes the tendency to running of cut edges.

SUMMARY OF THE DRAWINGS

The invention will be further described in connection with its embodiments of a single warp-knitted pile fabric, with reference being made to the accompanying drawings, wherein.

SUMMARY OF EMBODIMENTS OF THE INVENTION

Figure 1:
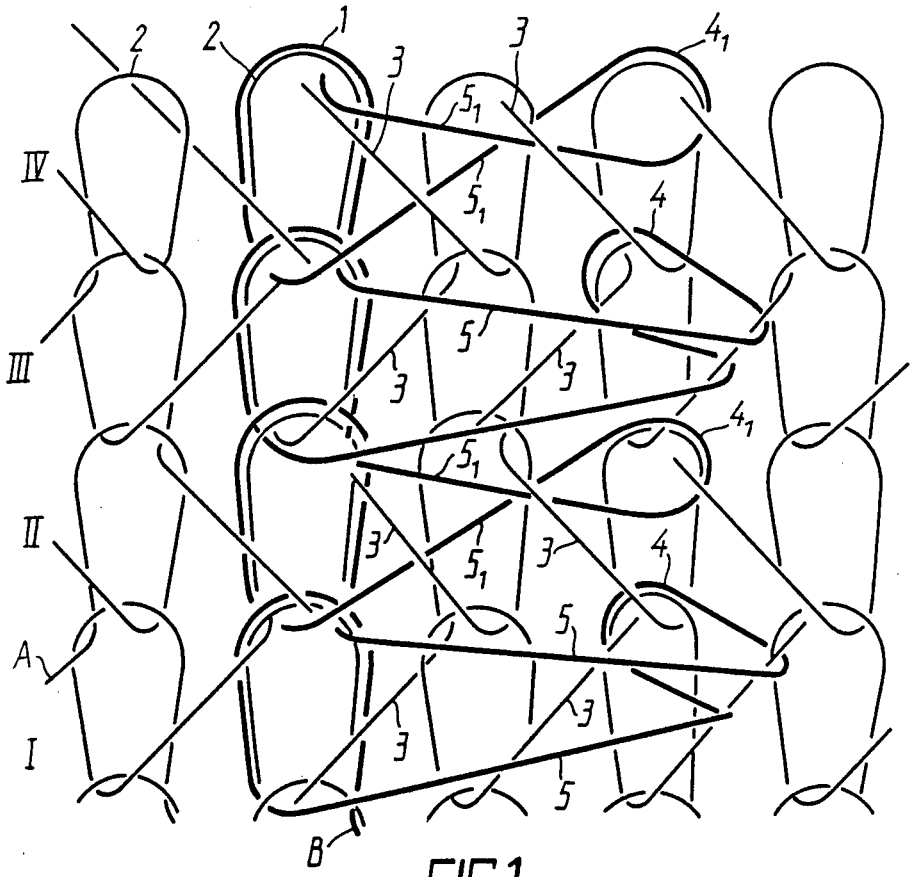
FIG. 1 illustrates the structure of a single warp-knitted pile fabric embodying the invention.
Figure 2:
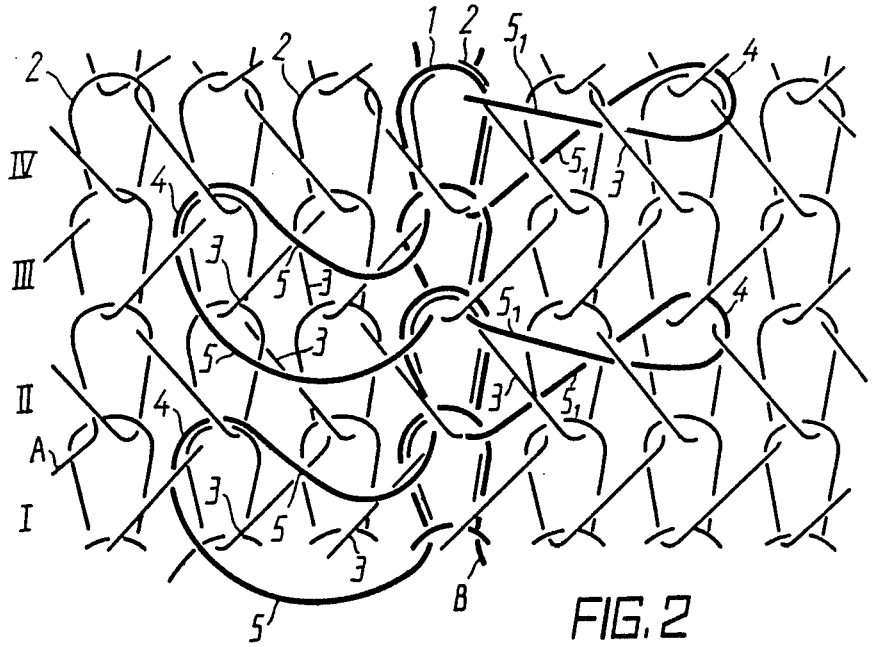
FIGS. 2 and 3 illustrate modified strurtures of the fabric of FIG. 1.
Figure 3:
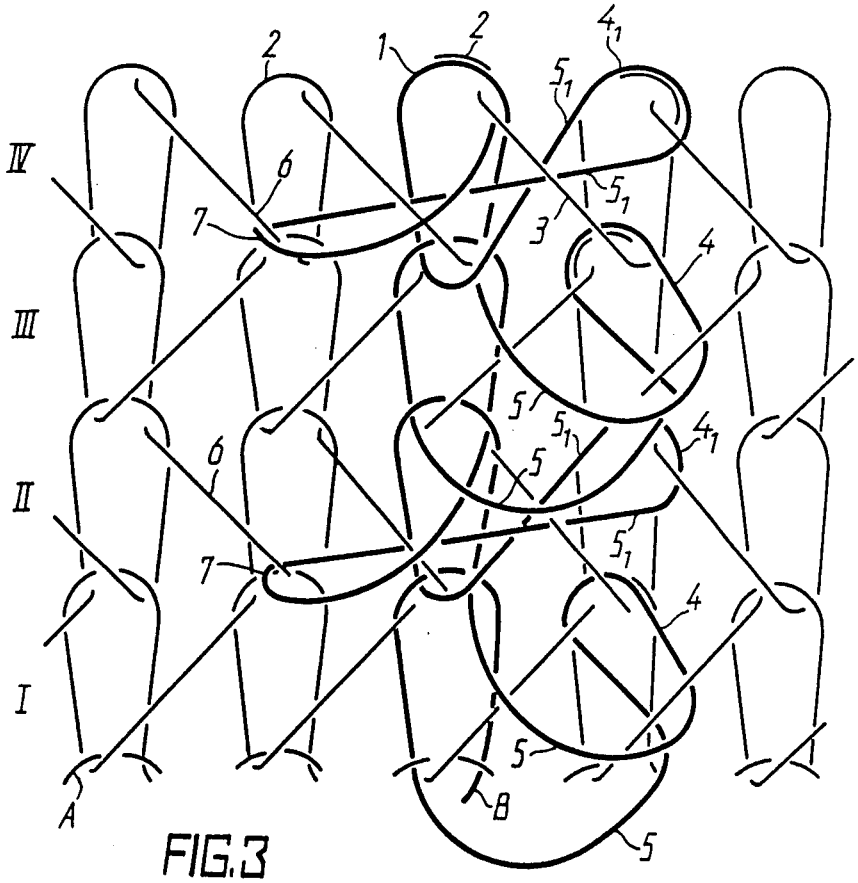

In the drawings, FIGS. 1 to 3, the single warp-knitted pile fabric is formed of two thread systems, viz. of leading or ground threads A shown in the drawings by thin lines, and of pile threads B shown in the drawings by bold lines; for better clarity only one pile thread B is shown.

The ground threads A and pile threads B are knitted into loop courses I, II, III, IV and so on, wherein all the loops 1 of the pile thread B are run jointly with the ground loops 2 and interconnected by the floats or necks 3 of the ground loops 2 and the floats or necks of the loops 1 of the pile thread B.

Also run on from the pile threads B are transfers 4 and $\mathbf{4_1}$ inlaid in the same loop courses I, II, III and IV as the loops 1 of these pile threads B.

In some loop courses (course I or course III) the floats 5 of the transfers 4 of the pile threads B are laid to overlie the floats 3 of the ground loops 2, whereas in other loop courses (course II or course IV) the floats $\mathbf{5_1}$ of the transfers $\mathbf{4_1}$ underlie the floats 3 of the ground loops 2.

The transfers 4 and $\mathbf{4_1}$ of the pile thread B can be laid on the floats 3 of the ground loops 2 of the adjacent loop column, or the second-next loop column, as shown, respectively, in FIG. 3 and FIGS. 1, 2.

In a preferred structure of the disclosed fabric, the loops courses I, III where the floats 5 of the transfers 4 overlie the floats 3 of the ground loops 2 alternate with the loops courses II, IV where the floats $\mathbf{5_1}$ of the transfers $4_1$ underlie the floats 3 of the ground loops 2. In the structure illustrated in FIG. 1 all the transfers 4 and $4_1$ of the pile thread B in the successive loop courses I, II, III, IV are situated to one and the same side of the loops 1 of this pile thread B.

The modification of the single warp-knitted pile fabric shown in FIG. 2 is similar to the fabric of FIG. 1 in that its loop courses I, III where the floats 5 of the transfers 4 overlie the floats 3 of the ground loops 2 alternate with the loop courses II, IV where the floats $5_1$ of the transferse $4_1$ underlie the floats 3 of the ground loops 2.

However, in this structure of FIG. 2 the transfers 4 and $4_1$ of the pile thread B are situated in the adjacent courses (e.g. I and II) to opposite sides of the loop 1 of the pile thread B, i.e. the floats 5 of the transfers 4 are situated to one side of the loops 1 and 2, while the floats $5_1$ of the transfers $4_1$ are situated to the other side of these loops 1 and 2.

The single warp-knitted pile fabric of FIG. 3 is similar to the fabric of FIG. 1 in that it comprises ground loops 2 and loops 1 of the pile thread B run jointly with the ground loops 2, and transfers 4 and $4_1$ of the pile thread B laid in the same loop courses I, II, III and IV as the loops 1, with the floats 5 of the transfers 4 of the pile thread B in some loop courses (I and III) overlying the floats 3 of the ground loops 2, and the floats $5_1$ of the transfers $4_1$ in other courses (II and IV) underlying the floats 3 of the ground loops 2.

In this structure of FIG. 3 all the transfers 4 and $4_1$ of the pile thread B in the loop courses I, II, III and IV are situated to one and the same side of the loops 1 and 2, respectively, of the pile thread B and of the ground thread A. One of tthe floats $5_1$ of each transfer $4_1$ of the pile thread B in the loop course II or IV where it overlies the floats 3 of the ground loops 2 is led to the side opposite to the location of the transfer $4_1$, to interlock the float 6 of a ground loop 2 situated in the same loop course II or IV to the other side of the loop 1 of the pile thread B, so that an additional transfer 7 is formed from this float $5_1$.

This additional transfer 7 can be also laid over the second-next loop column in the structures of the knitted pile fabric illustrated in FIGS. 1 and 2.

The disclosed single warp-knitted fabric can be produced by known per se warp-knitting machines employing two thread systems, using techniques well known to those competent in the art.

Thus, the distinguishing structural features of the disclosed single warp-knitted fabric provide for enhanced surface-filling of the fabric and improved runproof quality of cut edges, which facilitates fabrication of various items and articles from this fabric.

We claim:

1. A single warp-knitted pile fabric of ground threads and pile threads, comprising: loop courses of the ground threads and of the pile threads, wherein the loops of the pile threads are run jointly with the loops of the ground threads; floats, respectively, of the loops of the ground threads and of the loops of the pile threads, interconnecting said courses; transfers of the pile threads laid in the same said loop courses where the loops of said pile threads are run; the floats of said transfers in some of said courses overlying the floats of the ground loops and in other ones of said courses underlying the floats of the ground loops.

2. A single warp-knitted pile fabric as set forth in claim 1, wherein said some loop courses where said floats of said transfers overlie the floats of ground loops alternate with said other ones of said loop courses wherein said floats of said transfers underlie the floats of the ground loops.

3. A single warp-knitted pile fabric as set forth in claim 1, wherein all said transfers of said pile threads in said loop courses are situated to one and the same side of the loops of said pile threads.

4. A single warp-knitted pile fabric as set forth in claim 1, wherein said transfers of said pile threads in adjacent ones of said loops courses are situated to opposite sides of the loops of said pile threads.

5. A single warp-knitted pile fabric as set forth in claim 1, wherein one of said floats of each said transfer of the pile threads in that one of said loop courses where it underlies the floats of the ground loops is led to a side opposite to the location of the transfer, to interlock the float of a ground loop situated in the same said loop course to the other side of the loop of said pile thread.

* * * * *